United States Patent [19]

Rickard

[11] Patent Number: 4,670,984

[45] Date of Patent: Jun. 9, 1987

[54] FOLDING KNIFE

[76] Inventor: Thomas A. Rickard, 2300 S. Hope St., Ste. 400, Los Angeles, Calif. 90007

[21] Appl. No.: 852,570

[22] Filed: Apr. 16, 1986

[51] Int. Cl.[4] ..... B26B 1/04

[52] U.S. Cl. ..... 30/161

[58] Field of Search ..... 30/161, 160

[56] References Cited

U.S. PATENT DOCUMENTS

| | | | |
|---|---|---|---|
| 4,170,061 | 10/1979 | Henry | 30/160 |
| 4,272,887 | 6/1981 | Poehlmann | 30/161 |
| 4,404,748 | 9/1983 | Wiethoff | 30/161 |
| 4,439,922 | 4/1984 | Sassano | 30/161 |
| 4,541,175 | 9/1985 | Boyd | 30/161 |
| 4,604,803 | 8/1986 | Sauby | 30/161 |

*Primary Examiner*—Jimmy C. Peters

*Attorney, Agent, or Firm*—Fulwider, Patton, Rieber, Lee & Utecht

[57] ABSTRACT

A lockable folding knife utilizes a simplified, easily manufactured combination pivot and locking pin mechanism to create a strong locking action between the hub of the knife blade which pivots about the pivot pin, and the locking pin which is connected to and moved by the pivot pin when it is displaced in an axial direction.

6 Claims, 6 Drawing Figures

FOLDING KNIFE

BACKGROUND OF THE INVENTION

Folding knives are well known in the art and serve a variety of uses. Naturally, the primary purpose of the folding feature is to sheath the sharpened blade so that the knife may be carried without an additional cover or sheath and to reduce the overall length of the knife for more convenient carrying. Numerous designs of folding knives have been developed in the past, both of the locking and unlocked variety. The primary benefits of the simple, non-locking foldable knife are its simplicity and economy, since there is only one moving part, the blade. However, the inability to lock the blade in its deployed position places serious limitations on the use of such a knife for purposes such as self defense and other demanding activities.

Locking foldable or retractable knives have taken many forms, including blades which slide out of the handle and lock down and pivoting blades which are released and locked by one or more buttons operated by the user. While such knives have broad utility and are available in many forms, they all suffer from one or more of the following deficiencies: unreliable operation, numerous moving parts, inconvenient operation and failure of the locking mechanism. Therefore, despite the long and continued development of folding knives capable of being positively locked in the open position, there still exists the need for a simple, reliable, strong locking and pivoting mechanism for such a knife. Another desirable feature for a folding knive is the ability of the knife locking mechanism to accommodate rotational alignment of the blade in the stored and deployed positions other than 180° positions. Many of the knives currently available are not easily adaptable to such a requirement.

SUMMARY OF THE INVENTION

The invention provides a unique and simple mechanism which allows the construction of a folding knife which has a strong positive locking feature and achieves this functionality with fewer moving parts and the ability to adapt to a wide variety of open and closed positions. The invention also reduces the number of projections and appurtenancies upon the locking mechanism, thereby preventing, to a great degree, accidental activation of the locking mechanism. Moreover, the locking mechanism of the present invention is relatively simple and inexpensive to manufacture, is troublefree and reliable in use and attains its improved result without limiting the application to a restricted configuration of knife blade and handle.

The invention utilizes a simplified pivot and locking pin mechanism to create a strong locking action between the hub of the knife blade, which pivots about the pivot pin, and the locking pin which is connected to and moved by the pivot pin when it is displaced in an axial direction.

The present invention provides a folding knife construction which is more reliable, more convenient, stronger and uses few moving parts than those taught by the art. The invention is particularly useful for knives which are to be subject to relatively large amounts of stress upon the blade when it is deployed. The invention accomplishes these advances in the art by combining the locking mechanism and pivot for the blade in a single functional entity which is displaced axially to provide the unlocking of the blade. It is a further feature of the invention that the locking mechanism is displaced radially from the binge pin, thereby providing, in addition to means required to lock the blade, a means, in combination with one or more detents in the blade, to provide locking positions of the blade which was to be at angles to one another other than 180°.

The knife blade, according to the present invention, is formed so as to include a relatively strong hub from which the projecting knife blade extends. The hub is configured to include a central bore and a plurality of detents formed at intervals radially displaced around the bore corresponding to open and closed positions in which the knife blade is to be locked. The handle is formed by two sides which are spaced apart by a spacer. The spacer is so configured that when used in combination with the two sides, a cavity is formed between the sides into which the knife blade may be folded when pivoted around the pivot pin such that the sharpened portion of the knife blade is housed within the handle. The handle contains a bore at one end into which a pivot pin is inserted. The bore in the handle is formed so that there is a blind end in one side and the bore extends through the opposite side. The pivot pin is inserted into the bore and the bore in the knife blade hub, thereby providing the axis about which the knife blade may be rotated. The pivot pin and the bores in the knife blade and hub are perpendicular to the housing in the handle and the plane of the knife blade. Attached to the pivot pin at the end which rests in the blind end of the bore is a lock pin which is configured to engage detents in the knife blade hub when displaced axially in combination with the pivot pin. The lock pin is positively attached to the pivot pin and is housed within a cavity adjacent and connected to the pivot bore in the side of the handle containing the blind end of the pivot bore. A spring housed within the blind end of the pivot pin bore urges the pivot pin and lock pin to its closed position in which it engages the detents on the blade. In this position, the lock pin engages both the detent in the blade hub and the lock pin housing in the handle, thereby positively locking the blade in that position. When the pivot pin is urged axially so as to compress the spring, the lock pin disengages from the detent and slides into the handle, thereby allowing the blade to rotate about the pivot pin. By use of this simple, strong and easily manufactured mechanism, the knife described by this invention provides a strong and reliable folding knife suitable for a variety of uses.

Other features and advantages of the present invention will become apparent from the following detailed description taken in conjunction with the accompanying drawings which illustrate, by way of example, the principles of the invention.

DETAILED DESCRIPTION OF THE DRAWINGS

As shown in the exemplary drawings, the present invention is embodied in a novel locking mechanism which allows positive deployment or retraction of a knife blade which is mounted to totate about a pivot pin, housed in the handle of the knife. The mechanism is simple, inexpensive to manufacture, rugged and has a minimum number of moving parts consistent with reliable operation. Knives are extremely useful tools but their utility is substantially decreased if they present a hazard to the user. In order to decrease the problems associated with carrying a knife in which the blade at all times extends from the handle, pivoting and extensible blades have been incorporated into pocket knifes for some time. A means of positively locking the blade in its extended and retracted positions is very desireable, but many previous mechanisms to achieve this result have suffered from complication and unreliability in their application as well as difficulty of fabrication. The present invention provides a simple, reliable and sturdy means of locking a rotatable knife blade in various positions, both extended and retracted. It achieves this result with a minimum number of parts and a mechanism which is economcially fabricated.

Figure 1:
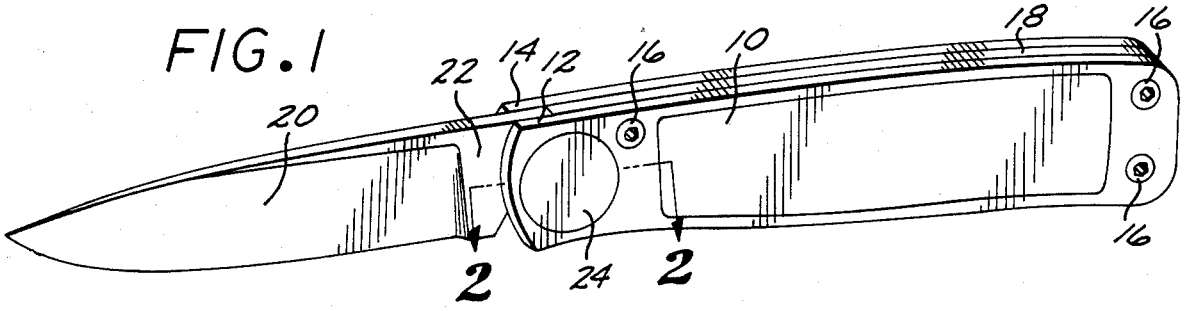
FIG. 1 is a perspective view of a knife incorporating the invention showing the overall configuration of the knife, including the extended blade and the handle.

Referring to FIG. 1, which shows a perspective of a preferred embodiment of the knife with the blade in the deployed position, handle 10 is formed by sides 12 and 14 which are riveted or screwed together by fasteners 16 which attach the sides to spacer 18. Blade 20 extends from the handle 10 where it is free to pivot on hub 22 about pivot pin 24.

Figure 2:
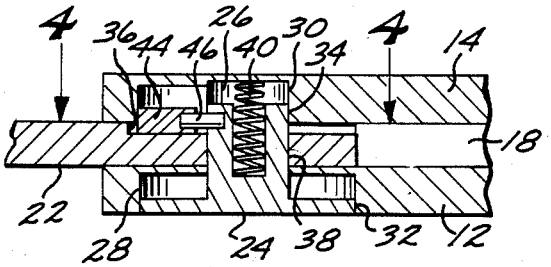
FIG. 2 is a cross section of the knife at section 2 of FIG. 1 showing the locking mechanism in its locked position.

FIG. 2 shows a cross section at 2 of the pivot and locking pin mechanism in its locked position. Handle sides 12 and 14 with spacer 18 form the housing in which the pivot pin bore 26 is formed. A pivot pin bore has two diameters, a larger diameter 28 and a smaller diameter 30, into which the pivot pin 24 is received. The pivot pin is likewise formed so as to have a larger diameter 32 and a smaller diameter 34, each of which are sliding fits in the respective bores formed in the handle. Knife blade hub 22 is configured with a bore 38 which receives the pivot pin 24 and thereby is configured to pivot about the pivot pin in a plane parallel to the handle's sides and the plane of the knife blade. Spring 40 is housed in the blind end 42 of the pivot pin bore and urges the pivot pin outward away from the blind end of the pivot pin bore. Detent 36 is formed in the hub 22 of the knife blade 20 and receives the lock pin 44 which is attached to the pivot pin 24 with tab 46 thereby providing an integral assembly such that the pivot pin and the lock pin move together when the pivot pin is axially displaced against the force of the spring 40 which in the locked position, lock pin 44 engages both the cavity in the handle into which it retracts 50 and the detent 36 in the knife blade hub, thereby pivotly locking the blade in this position.

Figure 3:
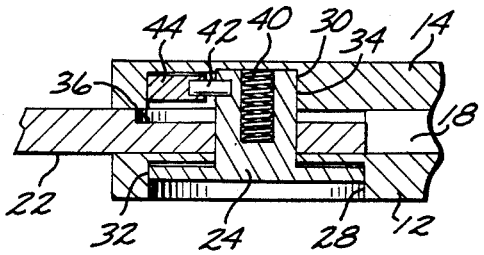
FIG. 3 is a cross section similar to FIG. 2 showing the locking mechanism in its disengaged position.

FIG. 3 shows the pivot pin displaced in an axial fashion thereby compressing spring 40 and causing locking pin 44 to be disengaged from detent 36 in the hub 22 of knife blade 20 thereby allowing knife blade 20 to pivot about the pivot pin without restriction. The larger diameter of the pivot pin 34 is of such a depth 48 that when displaced so as to disengage the lock pin 44 from detent 36, sufficient clearance exists between the bottom of the larger bore of the pivot pin housing and the larger diameter of the pivot pin that such motion is not restricted.

Figure 4:
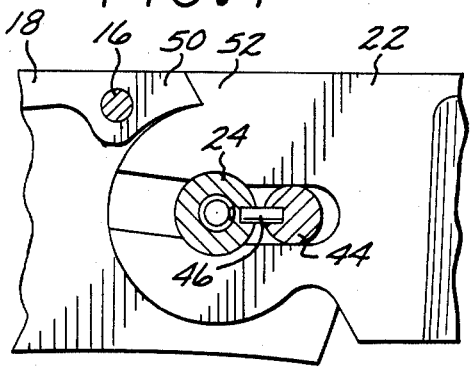
FIG. 4 is a cutaway of the locking mechanism showing the knife blade in its deployed position.

FIG. 4 is a cross section of the knife blade and handle at section 4 of FIG. 2 and illustrates the detent and the cross section of the pivot pin and the lock pin in the disengaged position. In this view, lock pin 44 engages detent 36 which is formed in knife blade hub 22 at an angle corresponding to the deployed position. Blade stop 50 operating against shoulder 52 in the hub also serves to positively prevent the knife blade from extending beyond the deployed position when it pivots about pivot pin 24 and bore 38 in hub 22.

Figure 5:
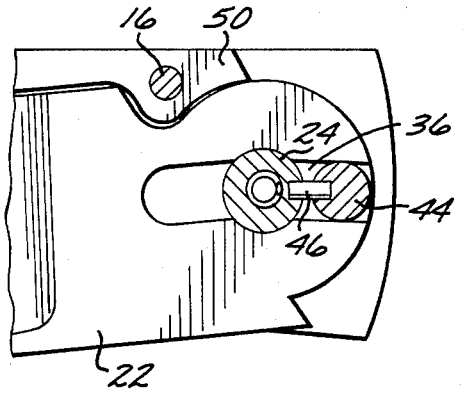
FIG. 5 is a cutaway of the locking mechanism, blade and handle at section 4 of FIG. 2 with the knife blade in the closed position.

FIG. 5 illustrates the knife blade 20 in the retracted position and shows detent 36 being engaged by lock pin 44 such that the knife blade is, when rotated about pivot pin 24 on bore 38 in knife blade hub 22, the knife blade is positively retracted into the handle.

Figure 6:
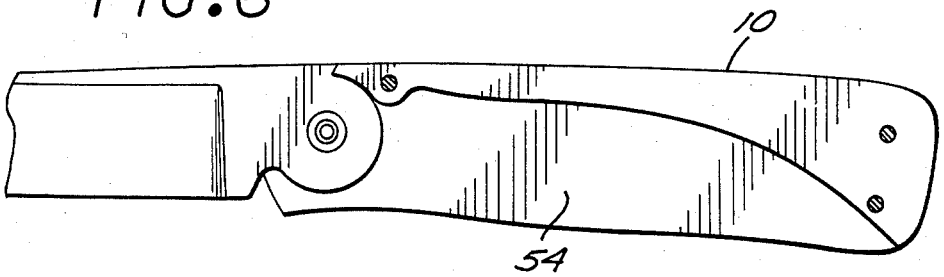
FIG. 6 is a cross section of the knife in its extended position with the cross section taken at the center line of the knife blade and handle.

FIG. 6 illustrates the relationship of knife blade 20, the shoulder 52, the handle 10 and the blade stop 50 in the knife blade hub 22 and their relationship when the blade is in the deployed position. Also illustrated is the cavity 54 in handle 10 in which the knife blade is housed when rotated to its undeployed position.

From the foregoing, it will be appreciated that the present invention provides a reliable, simple, rugged means to provide a rotation and locking mechanism for a folding knife which is easily fabricated, inexpensive to make and reliable in operation. While several particular forms of the invention have been illustrated and described, it will be apparent that various modifications can be made without departing from the spirit and scope of the invention.

Accordingly, it is not intended that the invention be limited except as by the appended claims.

I claim:

1. I claim a folding knife which comprises:

a blade;

a handle;

said handle further comprising two opposed sides and a spacer, said spacer being configured such that when said sides are attached to said spacer, the combination thereof forms a handle and provides a recess into which said blade may be housed, said handle including a pivot bore near one end of said handle, said pivot bore having a larger diameter and a smaller diameter, said pivot bore having an adjacent lock pin bore parallel to and connected to said pivot bore, said pivot bore having a blind end in one of the sides of said handle and being bored through the opposing side, said locking pin bore being located only in the side containing said blind pivot bore, said lock pin bore also being blind, said lock pin bore having its open side connected to said recess;

said blade further comprising a relatively thin portion which forms the cutting portion of the knife and a hub which includes a pivot bore and a plurality of locking detents;

a pivot pin which includes an appurtenant locking pin, said pivot pin having a larger diameter and a smaller diameter, said larger diameter being at one end of said pivot pin, said smaller diameter being the remainder of said pin, said larger and smaller diameters on said pin having a slip fit in said larger diameter and smaller diameter respectively in said pivot bores in said handle, said pivot pin appurtenant lock pin engaging said locking detents in said blade and said lock pin bore in said handle when said pivot pin is in its locked position in said pivot bore and said locking pin is disengaged from said locking notches when said pivot pin is displaced axially from said locked position; and means to urge said pivot pin to the locking position when undisturbed by a force acting axially upon said pivot pin.

2. The folding knife of claim 1 wherein said pivot pin larger diameter portion is such a length, and said larger diameter of such pivot bore is of such a length that the pivot pin is flush with the outside of the handle and may be axially displaced in said larger diameter of said bore to disengage said locking pin, thereby allowing said blade to pivot upon said pivot pin.

3. The folding knife of claim 1 wherein said means to urge said pivot pin to said locked position comprises a spring.

4. The folding knife of claim 3 wherein said spring comprises a helical spring acting upon the end of said smaller diameter portion of said pivot pin.

5. The folding knife of claim 1 wherein said locking pin further comprises a cylindrical portion and a tab, said tab fitting in grooves cut in the cylindrical portion and said pivot pin, said tab serving to lock said cylindrical portion and said pivot pin together, thereby forming said locking pin.

6. I claim a folding knife which comprises:

a blade;

a handle;

said handle further comprising two opposed sides and a spacer, said spacer being configured such that when said sides are attached to said spacer, the combination thereof forms a handle and provides a recess into which said blade may be housed, said handle including a pivot bore near one end of said handle, said pivot bore having an adjacent lock pin bore parallel to and connected to said pivot bore, said pivot bore having a blind end in one of the sides of said handle and being bored through the opposing side, said locking pin bore being located only in the side containing said blind pivot bore, said lock pin bore also being blind, said lock pin bore having its open side connected to said recess;

said blade further comprising a relatively thin portion which forms the useful portion of the knife and a hub which includes a pivot bore and a plurality of locking detents;

a pivot pin which includes an appurtenant locking pin, said pin having a slip fit in said pivot bore in said handle, said pivot pin appurtenant lock pin engaging said locking detents and in said blade and said lock pin bore in said handle when said pivot pin is in its locked position in said pivot bore and said locking pin is disengaged from said locking notches when said pivot pin is displaced axially from said locked position; wherein said locking pin further comprises a cylindrical portion and a tab, said tab fitting in grooves cut in the cylindrical portion and said pivot pin, said tab serving to lock said cylindrical portion and said pivot pin together, thereby forming said locking pin; and means to urge said pivot pin to the locking position when undisturbed by a force acting axially upon said pivot pin, said means to urge said pivot pin to the locking position further comprising a spring means.

* * * * *

UNITED STATES PATENT AND TRADEMARK OFFICE

CERTIFICATE OF CORRECTION

PATENT NO. : 4,670,984

DATED : June 9, 1987

INVENTOR(S) : Thomas A. Rickard

It is certified that error appears in the above-identified patent and that said Letters Patent is hereby corrected as shown below:

Column 3 line 13 delete "totate", insert --rotate--

Column 3 line 22 delete "knifes", insert --knives--

Signed and Sealed this

First Day of December, 1987

*Attest:*

DONALD J. QUIGG

*Attesting Officer*

*Commissioner of Patents and Trademarks*